US006524076B2

(12) United States Patent
Konishi

(10) Patent No.: US 6,524,076 B2
(45) Date of Patent: Feb. 25, 2003

(54) VARIABLE DISPLACEMENT PUMP INCLUDING A CONTROL VALVE

(75) Inventor: Hideo Konishi, Saitama (JP)

(73) Assignee: Bosch Braking Systems Co., Ltd., Tokyo (JP)

( * ) Notice: Subject to any disclaimer, the term of this patent is extended or adjusted under 35 U.S.C. 154(b) by 0 days.

(21) Appl. No.: 09/841,250

(22) Filed: Apr. 25, 2001

(65) Prior Publication Data

US 2001/0036412 A1 Nov. 1, 2001

(30) Foreign Application Priority Data

Apr. 27, 2000 (JP) ..... 2000-127563

(51) Int. Cl.[7] ..... F04B 49/00; F04B 1/06

(52) U.S. Cl. ..... 417/213; 417/219; 417/220; 417/30

(58) Field of Search ..... 417/213, 219, 417/220; 418/30

(56) References Cited

U.S. PATENT DOCUMENTS 3,924,970 A * 12/1975 Johnston et al. ..... 417/220
4,496,288 A * 1/1985 Nakamura et al. ..... 417/213
4,510,962 A * 4/1985 Mott et al. ..... 137/102
4,601,641 A * 7/1986 Kuroyanagi et al. ..... 417/220
5,028,214 A * 7/1991 Masuda ..... 417/218
5,876,185 A * 3/1999 Schimpf et al. ..... 417/212

FOREIGN PATENT DOCUMENTS

JP 5-240168 * 9/1993 ..... F04C/2/344
JP 8-200239 * 6/1996 ..... F04C/15/04

OTHER PUBLICATIONS

Japanese Abstract No. 08200239, dated Aug. 6, 1996.
Japanese Abstract No. 07243385, dated Sep. 19, 1995.
Japanese Abstract No. 06200883, dated Jul. 19, 1994.

* cited by examiner

*Primary Examiner*—Charles G. Freay
*Assistant Examiner*—Timothy P. Solak
(74) *Attorney, Agent, or Firm*—Sughrue Mion, PLLC

(57) ABSTRACT

A pump including a pump chamber 18, formed in a pump body 11, between a cam ring 17 and a rotor 15. The cam ring is formed so as to move in a direction whereby the pump capacity of the pump chamber increases and decreases. First and second fluid pressure chambers 33 and 34 are formed at opposite sides of the cam ring 17. The pump has a spool that is axially moved by a difference in fluid pressure between upper and lower stream sides of a metering throttle 50 connected to a discharge side passage 27 of the pump chamber. The spool is part of a control valve 30 that controls fluid pressure in at least the first fluid pressure chamber. An electronic driving unit, for example, a solenoid 60, applies axial thrust to the spool of the control valve.

11 Claims, 6 Drawing Sheets

VARIABLE DISPLACEMENT PUMP INCLUDING A CONTROL VALVE

BACKGROUND OF THE INVENTION

1. Field of the Invention

The present invention relates to a variable displacement pump used as an oil or fluid pressure source for a vehicle power steering system, for example.

2. Description of the Related Art

In the pump for a power steering system, it is desired that fluid pressure—of an amount sufficient to obtain auxiliary steering power corresponding to a steering state during operation of a steering wheel—is applied to a power cylinder of a power steering system. On the other hand, it is unnecessary to apply such pressure when there is no steering, as when the vehicle travels straight.

Moreover, in a power-steering-system pump, it is desired that supplying quantity of pressure fluid at high speed travel is less than at middle or low speed travel and travel stability at high speed straight travel is kept with rigid feeling of steering wheel at high speed travel.

A positive displacement pump driven by an engine of vehicle is generally used as the pump for a power steering system. The positive displacement pump is such that its discharge flow rate increases as the revolution cycle of the engine increases. Therefore, to use the positive displacement pump for a power steering system, a flow control valve is indispensable. The flow control valve controls the discharge flow rate from the pump so as to produce a definite quantity that is independent of the revolution cycle. However, in the positive displacement pump having such a flow control valve, the load to the engine does not decrease even if a part of the pressure fluid is returned to a tank through the flow control valve, and an energy saving effect is not obtained because the horse power required to drive the pump is the same.

To prevent such a disadvantageous condition, variable displacement vane pumps, that decrease discharge flow rate per one revolution of the pump (cc/rev) in proportion to a decrease of revolution cycle, have been proposed by Japanese Patent Laid-Open No. 200883/1994, Japanese Patent Laid-Open No. 243385/1995, and Japanese Patent Laid-Open No. 200239/1996. These variable displacement pumps are so called engine revolution cycle sensitive pumps, and the discharge flow rate of the pump can be decreased when the cam ring is moved in a direction in which the pump capacity of the pump chamber decreases by an amount corresponding to the magnitude of the fluid pressure on the discharge side of the pump when the engine revolution cycle (pump revolution cycle) increases.

Such a variable displacement pump can provide a large auxiliary steering power while stopped, or at low speed travel, because the discharge flow rate of the pump is increased even when the engine revolution cycle is small as when the vehicle is stopped or is traveling at low speed. Since the engine revolution cycle becomes large and discharge flow rate of the pump becomes small at high speed travel of the vehicle, steering having a moderately rigid feeling becomes possible.

Although a discharge quantity that follows engine revolution cycle is obtained at use as oil pressure source of a power steering system in this kind of variable displacement pump, other conditions, for example, the change of a steering state such as speed of the vehicle, the steering speed, the steering angle and etc. has not been considered in the past. Therefore, the following disadvantageous conditions may arise.

Since the conventional variable displacement pump is engine-revolution-cycle sensitive, when the engine revolution cycle becomes high—such as during acceleration, moving up a slope, and coming down a slope—even during low speed travel, the discharge flow rate from the pump decreases. During a steering operation at low speed travel, the necessary flow rate is not maintained in the power steering system because of the very small discharge of the pump. Therefore, there is the possibility that auxiliary steering power will be lost. Because of this problem, flow rate in the conventional pump is not decreased in an attempt to keep the necessary flow rate.

Therefore, the conventional variable displacement pump has a limit on decreasing the discharge flow rate from the pump when the engine revolution cycle increases. Therefore, a sufficient fluid supply and energy savings cannot be obtained.

According to such a variable displacement pump, from the point of saving energy, the designated auxiliary steering power is obtained by supplying fluid of a designated flow rate when steering is need, and by supplying fluid at almost zero or a necessary minimum flow rate when steering is not necessary. For example, when the variable displacement pump is directly driven by the engine of the vehicle, a discharge quantity from the pump is unnecessary when there is no steering, even when the engine revolution cycle is large. Further the horse power necessary to drive the pump is lowered by decreasing the discharge quantity of the pump of this time.

When this kind of variable displacement pump is controlled, it is desirable to carry out the most suitable pump control according to the travel state of the vehicle by judging whether the vehicle stops, travels with low speed, middle speed, or high speed, and whether or not steering is carried out at each travel state. Therefore, it is necessary to determine such travel state and steering state of the vehicle so that pump control suitably is performed. Further, in order to obtain an energy saving effect in the variable displacement pump, the operating state of the pump and the travel state of the vehicle must be determined in order to carry out control of the pump at a designated condition.

SUMMARY OF THE INVENTION

The invention is carried out in view of the above-described situation. An object of the invention is to obtain a variable displacement pump wherein pressure loss of a throttle part provided at a discharge side passage is decreased without response delay when operation of the power steering system requires auxiliary steering power, and wherein necessary and sufficient flow rate is supplied. Further, the variable displacement pump can decrease the power consumption required to drive the pump, shows the maximum saving energy effect, and has high reliability.

Another object of the invention is to obtain a variable displacement pump which is an oil pressure pump for a vehicle power steering system and which provides a comfortable steering feeling by control corresponding to a travel condition such as speed of the vehicle, steering speed, etc. Further, the variable displacement pump can better show an energy saving effect by decreasing its discharge flow rate as soon as possible when steering is unnecessary such as when the vehicle travels straight. The discharge quantity of the pump is instantly increased to a necessary quantity when steering is requested, and designated auxiliary steering power is maintained.

To meet such an object, a variable displacement pump according to the invention comprises: a pump body holding a cam ring for movement in a direction whereby pump capacity of a pump chamber increases and decreases, the cam ring forming a first and a second fluid pressure chambers at opposite sides thereof; a spool movable in an axial direction by a difference in fluid pressure between upper and lower stream sides of a metering throttle connected to a discharge side passage of the pump chamber; and a control valve controlling at least fluid pressure in the first fluid pressure chamber; wherein an electronic driving unit applying axial thrust to the spool of the control valve is provided.

According to the invention, by forcibly applying axial thrust to the spool of the control valve by operating the electronic driving unit in response to a condition wherein steering is required for example, the control valve is electrically controlled in addition to the usual fluid pressure control, and the cam ring is instantly moved as a result.

That is, according to the invention, the spool of the control valve is positioned at a designated place in the axial direction by balancing a difference in upper and lower stream sides of the metering throttle, and discharge flow rate of pressure fluid from the pump chamber can be kept minimum. When axial thrust acts on the spool by the electronic driving unit, discharge flow rate of pressure fluid from the pump chamber can be increased to a desired value by connecting the pump suction side to the first fluid pressure chamber, for example, and by connecting fluid pressure of the lower stream side of the metering throttle to the second fluid pressure chamber.

By selectively connecting fluid pressure of the upper stream side of the metering throttle and the pump suction side to the first fluid pressure chamber, and by connecting fluid pressure of the lower stream side of the metering throttle and the pump suction side to the second fluid pressure chamber in the above-mentioned control valve, the difference in fluid pressure between the first and second fluid pressure chambers for moving the cam ring can be made large, and moving and displacement of the cam ring are surely carried out when necessary.

The variable displacement pump according to the invention further comprises an electronic control unit for driving and controlling the electronic driving unit, wherein the electronic control unit has a steering sensor for detecting steering speed of a steering wheel and drives and controls the electronic driving unit according to a signal from the steering sensor.

The variable displacement pump according to the invention further comprises an electronic control unit for driving and controlling the electronic driving unit, wherein the electronic control unit has a steering sensor for detecting steering speed of a steering wheel and a speed sensor detecting travel speed of vehicle, and drives and controls the electronic driving unit according to a signal from each of these sensors.

According to the invention, a variable displacement pump used for a fluid pressure source of a power steering system has a minimum flow rate when a steering operation is unnecessary, as during straight travel of vehicle. When auxiliary steering power—by the power steering system—is necessary, it is possible instantly to operate the electronic driving unit corresponding to steering speed, or to steering speed and speed of the vehicle, by the electronic control unit so as to keep sufficient flow rate of the pump discharge side.

DETAILED DESCRIPTION OF THE PRESENT INVENTION

Figure 1:
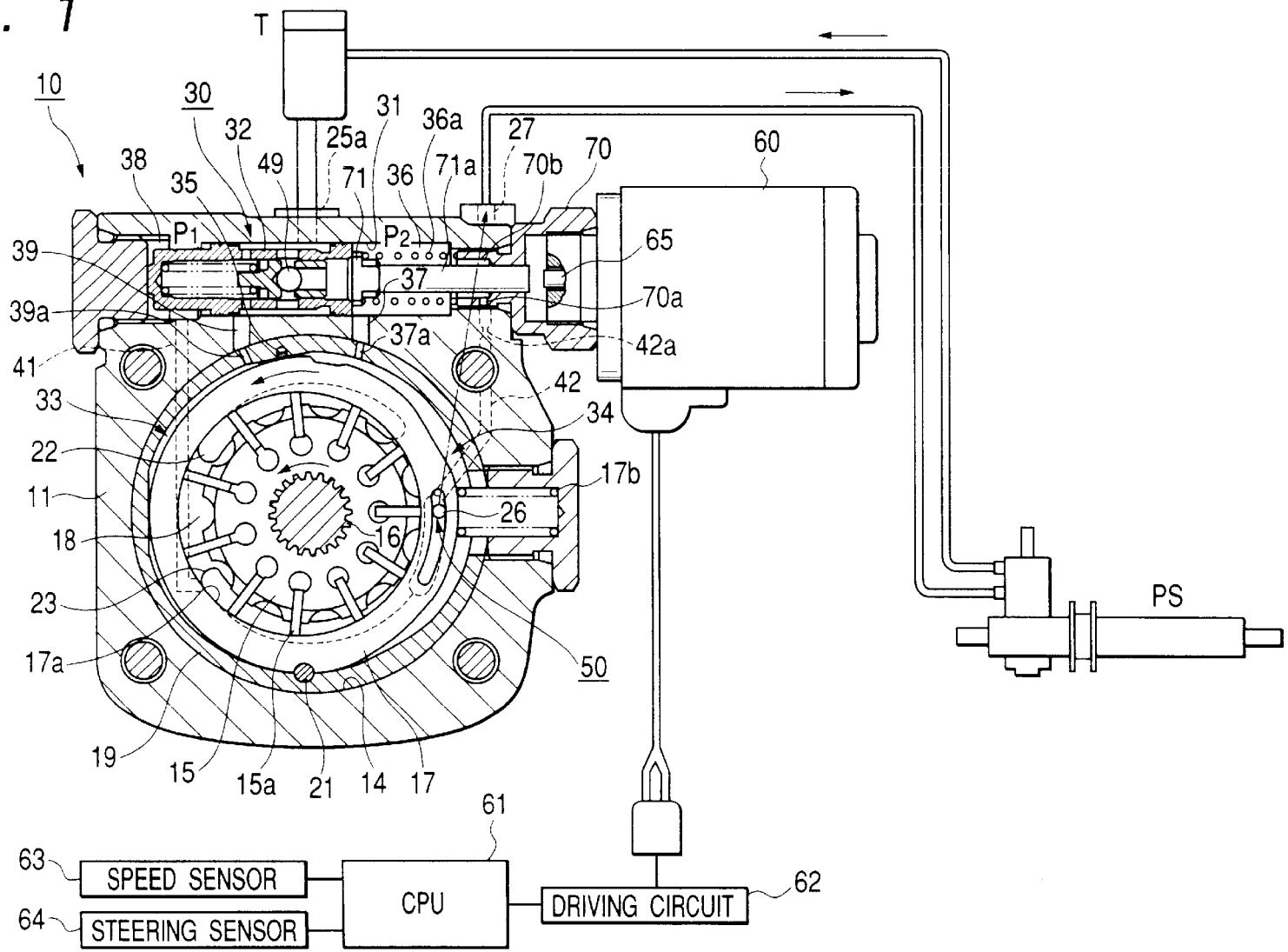
FIG. 1 shows a variable displacement pump of an embodiment according to the invention and shows a fluid pressure circuit construction using the pump.
Figure 2:
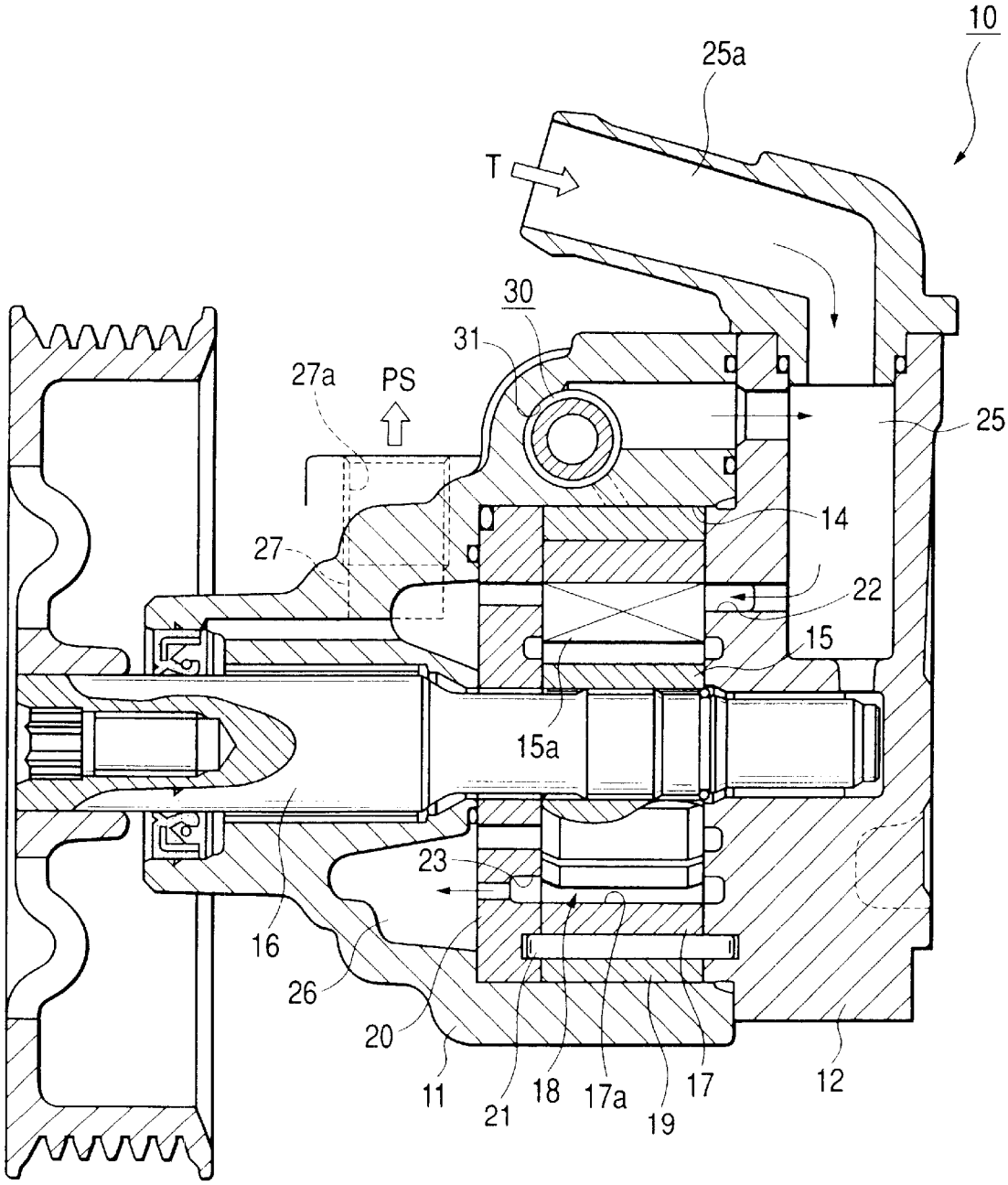
FIG. 2 is a side section view showing a cut main part of the variable displacement pump in FIG. 1.
Figure 3:
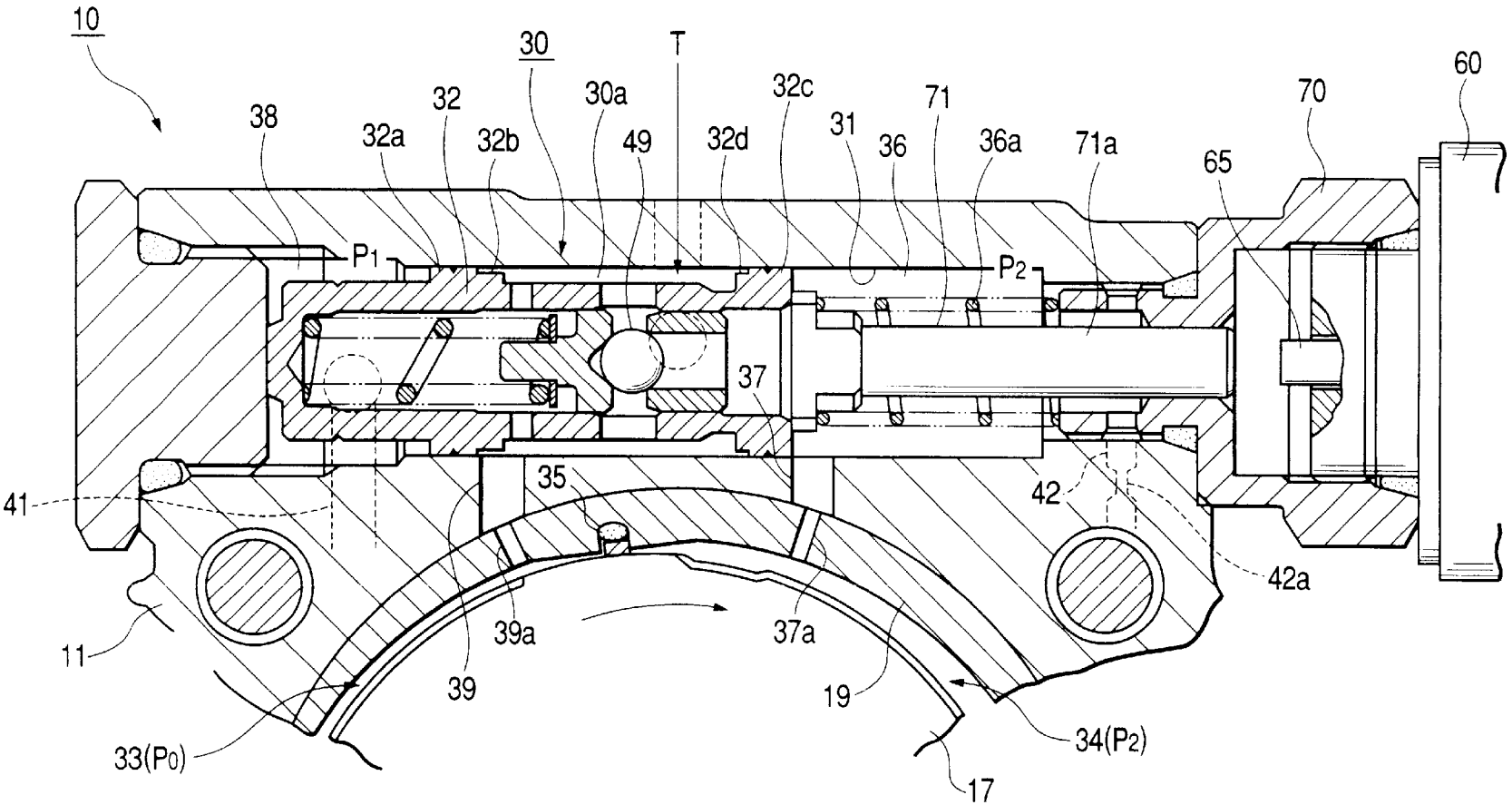
FIG. 3 is a main enlarged section view showing a control valve part of the variable displacement pump in FIG. 1.

FIGS. 1 to 3 are views showing an embodiment of a variable displacement pump according to the invention. In the embodiment, it is described that the variable displacement pump according to the invention is used for a vane type oil pump that is an oil pressure generating source of a power steering system.

In FIG. 1 and FIG. 2, a vane-type variable displacement pump shown with symbol 10 has a front body 11 and a rear body 12 forming a pump body. The front body 11 has an overall cup shape. A storage space 14, for storing and arranging pump composing elements, is formed at the inside of the front body 11. The rear body 12 is attached to the front body 11 so as to block the open end of the storing space 14.

The front body 11 rotatably supports a driving shaft 16 that rotatingly drives a rotor 15, which together comprise pump composing elements. The drive shaft 16 penetrates through the front body. The rotor 15 rotates counterclockwise in FIG. 1.

Symbol 17 is a cam ring, the cam ring 17 has an inside cam face 17*a* arranged for insertion into an outer circumference portion of the rotor 15 having vanes 15*a*. A pump chamber 18 is formed between the inside cam face 17*a* and the rotor 15. The cam ring 17 is biased relative to the rotor 15. An almost crescent-shaped space, that is formed between the cam ring 17 and the rotor 15, defines the pump chamber 18. The cam ring 17 is arranged to reciprocate in an adapter ring 19—fitted to an inner wall part in the storage space 14—so as to vary capacity (pump capacity) of the pump chamber 18 as described below. A compression coil spring 17*b* presses the cam ring 17 in a direction so that pump capacity of the pump chamber 18 becomes maximum.

In FIG. 2, symbol 20 shows a pressure plate. The pressure plate 20 is pressed to contact the front-body-11 side of a pump cartridge (pump composing elements) constructed by the above-mentioned rotor 18, cam ring 17, and adapter ring 19. At an opposite side face of the pump cartridge, the end face of the rear body 12 is contacted as a side plate. The front body 11 and the rear body 12 are assembled integratedly.

The pressure plate 20 and the rear body 12—being laminated to the cam ring 17—are assembled together by a reciprocation fulcrum pin 21. The reciprocation fulcrum pin 21 functions as a shaft fulcrum portion and a positioning pin allowing reciprocation of the cam ring 17, and functions as sealing material defining fluid pressure chambers on opposite sides of the cam ring 17.

Symbols 22 and 23 are a pump suction side opening and a pump discharge side opening opened at the pump chamber 18. Openings 22 and 23 are formed by an almost arc shaped groove portion, and are opened at a pump suction side area (of a start side) and a pump discharge side area (of an end side, in the revolution direction) of the rotor 15 as shown in FIG. 1. The suction side opening 22 is provided concavely facing the pump chamber 18 and is provided in the rear body 12. The discharge side opening 23 is provided concavely facing the pump chamber 18 and is provided in the pressure plate 20 as shown in FIG. 1.

At the rear body 12, a suction-side passage 25 is formed for supplying suction side fluid sucked from a tank T to the suction side opening 22 through a suction port. The suction side fluid sucked from the tank T (pump suction side) passes the pump suction side passage 25 in the rear body 12 from the suction port and is supplied into the pump chamber 18 from the suction side opening 22 opening at end face of the rear body 12. Symbol 25*a* is a pump suction side passage opening at a center part of a valve hole 31.

At a front side of the pressure plate 20, a discharge pressure chamber 26 of almost arc-shape is formed around the driving shaft 16. The pressure chamber 26 is connected to a discharge port 27*a* through a pump discharge side passage 27 formed in the front body 11, and discharges discharge side fluid pressure—guided to the pressure chamber 26—from the discharge port 27*a*.

Symbol 30 is a control valve comprising the valve hole 31 and a spool. The valve hole 31 is formed in a perpendicular direction to the shaft 16 at an upper side of the front body 11. The control valve is operated by axial thrust applied by a difference in pressure between an upper stream and a lower stream side of a metering throttle 50 provided at a part of the pump discharge side passage described below. Also, a solenoid 60, provided as an electronic driving unit, applies axial thrust to the spool. The control valve 30 controls fluid pressure in first and second fluid pressure chambers 33 and 34 formed at both sides of the cam ring 17. The pressure chambers are separated by sealing material 35 provided at the reciprocation fulcrum pin 21 and at the symmetrical position with respect of the axis in the adapter ring 19 as shown in FIG. 1 and FIG. 3.

At one end of the valve hole 31, a chamber is formed where fluid pressure of the pump discharge side is connected to a pilot pressure passage 41 from the pressure chamber 26 and fluid pressure P1 of the upper stream side of the metering throttle 50 is conducted.

At the other end of the valve hole 31, a spring chamber 36 is formed which has a compression coil spring 36*a* energizing the spool 32 to the one end. The spool 32 is energized to left side in FIG. 1. In the spring chamber 36, fluid pressure P2—of the lower side of the metering throttle 50, which is formed between the pump discharge side passage 27 and an apparatus using pressure fluid (here, a power cylinder PS of a power steering system)—is conducted by a pilot pressure passage 42.

Inside of the spool 32, a relief valve 49 is provided.

In the pilot pressure passage 42, a pilot throttle 42*a* may be provided as shown with a doted line in FIG. 3. By providing the pilot throttle 42*a,* undesirable influence, such as fluid pressure change and the like, to the spool 32 of the control valve 30 can be prevented. The pilot throttle 42*a* makes fluid pressure in the spring chamber 36 of the control valve 30 decrease at relief of the relief valve 49. Since the cam ring 17 reciprocates such that capacity of the pump chamber 18 decreases by operation of the control valve 30 causing a pressure decrease in chamber 36 , pump discharge quantity decreases so as to advantageously save energy of the pump.

The spring chamber 36 is connected by a connecting passage 37 to the second fluid pressure chamber 34 when the spool 32 is placed at the position of FIG. 1 and FIG. 3. When the spool 32 moves to the spring chamber 36 side (right side in the figure), the spring chamber 36 is gradually separated from the second fluid pressure chamber 34, which is thus connected to a pump suction side chamber 30*a* defined by ring-shaped groove formed at center part, in the axial direction, of the spool 32 through a gap passage defined by a small diameter portion 32*d* formed at a land portion 32*c* of one end side of the spool 32. Therefore, to the second fluid pressure chamber 34, fluid pressure P2 of lower stream side of the metering throttle 50 and fluid pressure of the pump suction side are supplied selectively through the spring chamber 36 and the pump suction side chamber 30*a* by moving the spool 32. At a part of the above-mentioned connecting passage 37, a damper throttle 37*a* is formed.

The pilot pressure passage 42 is connected to the spring chamber 36 through a hole portion 70*a* and an inner hole 70*b* formed at a part of a plug member 70 described below.

A high pressure side chamber 38, formed at one end side of the spool 32, is closed at non-operation, that is, when the spool 32 is placed at position of FIG. 1 and FIG. 3. Further, the connecting passage 39 is connected to the pump suction side chamber 30*a* through the gap passage defined by the small diameter portion 32*b* formed at the land portion 32*a* of one end of the spool 32.

Since fluid of the discharge side is supplied into the chamber 38 through the pilot pressure passage 41 when the pump 10 starts, the spool 32 moves to the spring chamber 36 side (right side in the figure) and the chamber 33 is gradually separated from the pump suction side and is connected to the high pressure chamber 38 through the connecting passage 39. Therefore, to the first fluid pressure chamber 33, fluid pressure of the pump suction side and fluid pressure P1 of upper stream side of the metering throttle 50 are supplied selectively through the pump suction side chamber 30*a* and the high pressure side chamber 38 with the movement of the spool 32. At a part of the connecting passage 39, a damper throttle 39*a* is formed.

By using the above-mentioned control valve 30, fluid pressure of the pump suction side is conducted to at least any of fluid pressure chambers 33 and 34 formed at both sides, in the moving direction, of the cam ring 17 in spite of small operation power (operation pressure caused by a difference in pressure and solenoid thrust) of the valve. Therefore, a certain moving displacement of the cam ring is obtained because the difference in fluid pressure between the fluid pressure chambers 33 and 34 is made large.

Since difference in fluid pressure (differential pressure) is small at the upper and lower stream sides of the metering throttle 50, just after the pump starts in the above-mentioned control valve 30, the spool 32 is placed at the position shown in FIG. 1 and FIG. 3. Further the first fluid pressure chamber 33 is connected to the pump suction side so that fluid pressure P0 is conducted. On the other hand, to the second fluid pressure chamber 34, fluid pressure P2 of the pump discharge side—at the lower stream side of the metering throttle 50—is conducted so that the cam ring 17 is in the sate that capacity of the pump chamber 18 becomes maximum.

Figure 4:
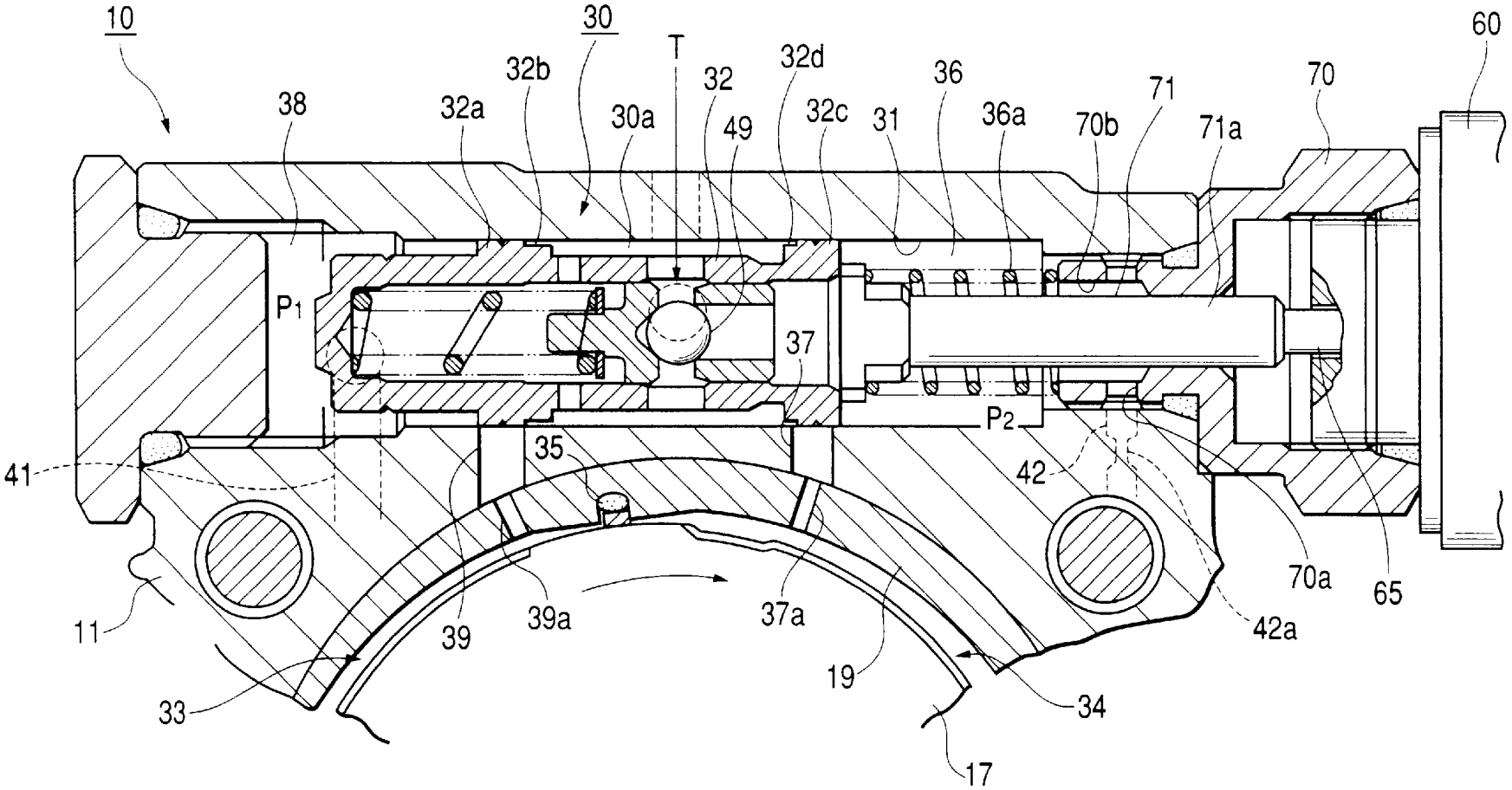
FIG. 4 is a main enlarged section view showing the valve part moving to a balanced state from a non-operation state of FIG. 3.

When discharge flow rate from the pump chamber 18 increases, and differential pressure at upper and lower stream sides of the metering throttle 50 increases to a designated differential pressure controlled by a fixed throttle of the metering throttle 50, the spool 32 moves in a direction whereby the spring 36*a* is compressed (i.e., the spool 32 moved towards the spring chamber 36 side) and thereby balance is kept at the designated position as shown in FIG. 4. At that time, the spool 32 becomes almost stable in the state that the pump suction side is connected, or is able to be connected, to the first and second fluid pressure chambers 33 and 34 on both sides of the cam ring 17.

In such the balancing state of the spool 32, the cam ring 17 is on the right side in the figure and the differential pressure between fluid pressure chambers 33 and 34 is balanced by the energizing force of the compressed coil spring 17*b*. Therefore, the pump chamber 18 becomes the minimum pump capacity. In this state, the pump 10 has the minimum pump discharge quantity, for example, 4 l/min. This value is suitably set by fixing the throttle quantity of the metering throttle 50, capacity of the pump chamber 18 and etc., so as to set the from necessary minimum auxiliary steering power.

In the above vane-type variable displacement pump 10, almost all constructions and operation states are well known from the past, so the particular description is omitted. The fundamental pump construction of the variable displacement pump 10 is almost the same as disclosed in Japanese Patent Laid-Open No. 200883/1994 and Japanese Patent Laid-Open No. 200239/1996.

According to the invention, in the variable displacement pump 10, a solenoid 60 is added as an electronic driving unit applying axial thrust to the spool 32 causing it to move towards the high pressure side chamber 38 from the spring chamber 36 side.

For the electronic control unit of the solenoid 60, a CPU 61, a driving circuit 62, a speed sensor 63, and a steering sensor 64 are provided.

In detail, a screw hole is provided at the spring chamber 36 side of the control valve 30, and the plug member 70 is screwed into the screw hole to fix it to the control valve 30. At an outer end of the plug member 70, the solenoid 60 is attached so that a solenoid rod 65 extends therefrom. The solenoid rod 65 is assembled at an end portion of the spring chamber 36 side of the spool 32, and faces the tip end of a rod 71*a* of a rod member 71 held reciprocatingly at an inner end of the plug member 70.

Although these rods 65 and 71*a* face each other across a designated gap at a non-operating state of the pump 10 as shown in FIG. 1 and FIG. 3, they contact as shown in FIG. 4 when the pump operates.

In such construction, the condition shown in FIG. 4 is kept at a non-steering state and the discharge flow rate from the pump 10 is the minimum flow rate controlled the metering throttle 50. At this time, the solenoid is kept in a non-conductive state.

In such a balanced state, the pump discharge flow rate corresponding to speed of the vehicle, steering speed, etc., is obtained when steering is required. That is, designated current flow through the solenoid 60, by signals from sensors 63 and 64, passes through the CPU 61 and the driving circuit 62. The rod 65 applies thrust to the spool 32 through the rod member 71 to the left direction in the figure as shown in FIG. 4. Then, the spool 32 moves to left side in the figure corresponding to the thrust based on the magnitude of the current and the first fluid pressure chamber 33 is connected to the pump suction side (P0). The second fluid pressure chamber 34 is connected to fluid pressure P2 of the lower stream side of the metering throttle 50, thereby the cam ring 17 moves to left side in the figure so as to make the capacity of the pump chamber 18 large. Therefore, discharge quantity from the pump 10 is increased by a value controlled by the above-mentioned electronic control unit (symbols 61 to 64).

Figure 6:
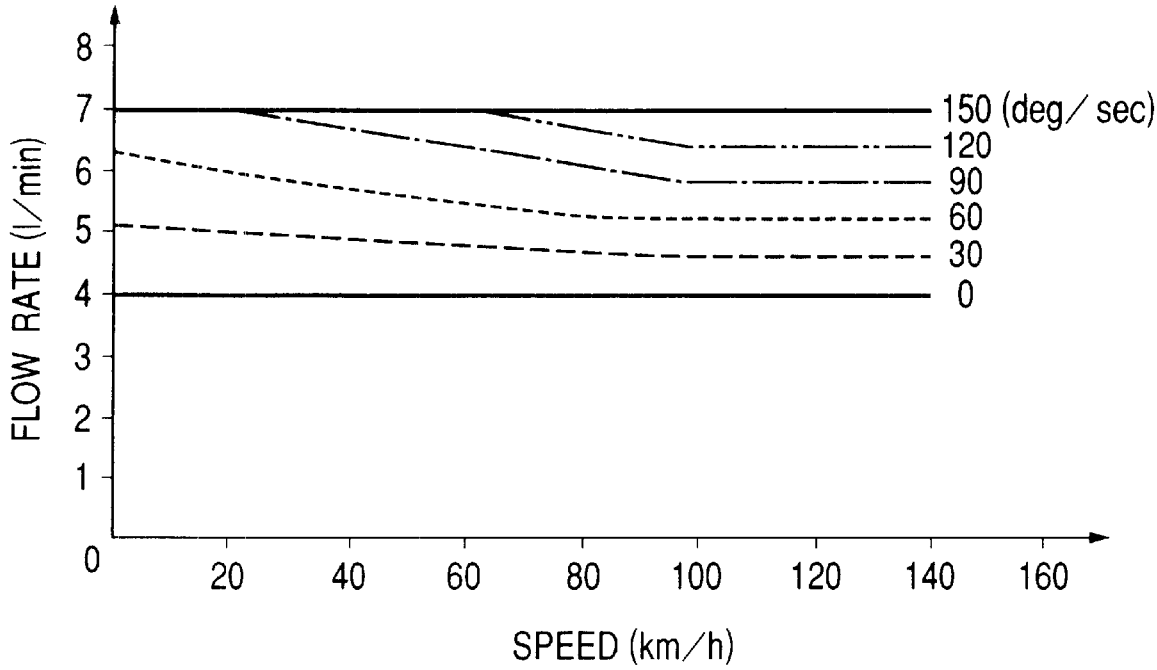
FIG. 6 shows a supply flow rate characteristic during straight travel, and during steering, when the variable displacement pump according to the invention is used as a fluid pressure source of a power steering system.

An example of such flow rate characteristic is shown in FIG. 6. Here, a thick solid line shows the minimum flow rate of the variable displacement pump 10 according to the invention (for example, 4 l/min), and a thin solid line is the maximum flow rate necessary at quick steering (for example, 7 l/min). These are certain flow rates that are not influenced by the speed of the vehicle.

When the speed changes, the flow rate characteristic is shown in FIG. 6 as depending on steering speed (deg/sec).

By controlling the flow rate characteristic in such a manner, the spool 32 of the control valve 30 moves so as to keep the minimum flow rate (for example, 4 l/min) controlled by the metering throttle 50 and keeps that state at non-steering. Since the spool 32 is kept in a balanced state with the minimum flow rate at non-steering, differential pressure at the metering throttle 50 can be set small. Therefore, pressure loss at the metering throttle 50 is small. Since the solenoid 60 is in a non-conductive state at this time, the power consumption necessary for driving the pump 10 can be reduced, and the power consumption of the electronic control system also can be reduced.

Figure 5:
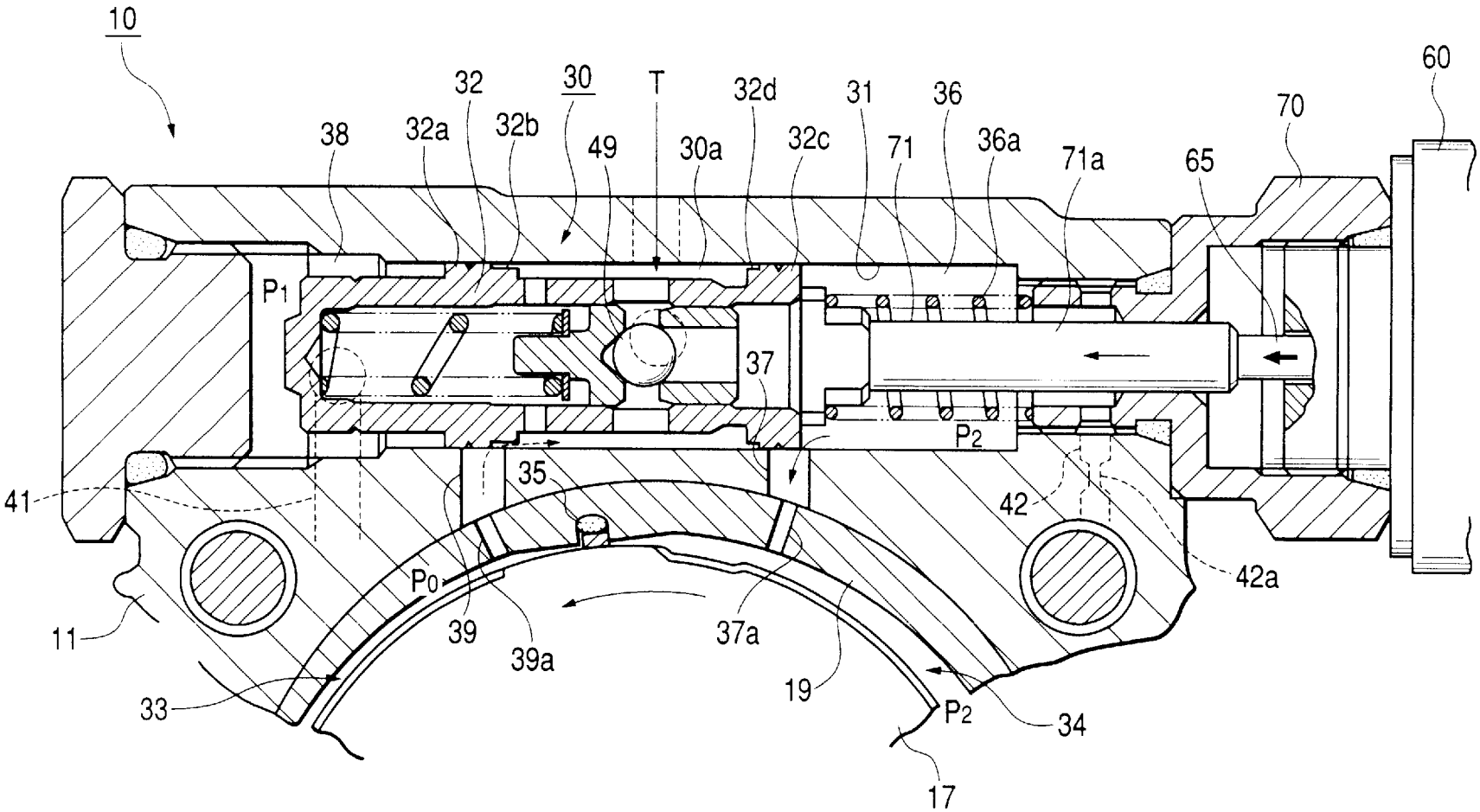
FIG. 5 is a main enlarged section view, similar to FIGS. 3 and 4, but showing a state wherein the maximum flow rate is discharged.

On the other hand, at steering, instantly the spool 32 is moved to left side in the figure, from the state of FIG. 4 to the state of FIG. 5, by thrust generated by the solenoid and corresponding in magnitude to current flowing through the solenoid 60. Thus, it is possible to control fluid pressure of the first and second fluid pressure chambers 33 and 34 and to generate designated auxiliary steering power by increasing quickly the pump discharge quantity to the designated flow rate. Therefore, it is possible to generate the designated auxiliary steering power, and to keep acceptable performance of the power steering system, without response delay even during quick steering.

In other words, according to the construction of the above-mentioned invention, auxiliary steering power can be suitably operated, when a steering operation is necessary, independent of the travel state, by controlling the flow rate of pressure fluid applied from the variable displacement pump to the power steering system. Further, since the solenoid 60 is in the non-conductive state at non-steering, such as during straight travel, the spool 32 of the control valve 30 keeps the balanced state of FIG. 4. Since pump discharge flow rate is kept minimum in this balanced state, and differential pressure to keep the minimum flow rate at this state is small, pressure loss at the metering throttle 50 is small. Therefore, a large energy saving effect is expected in the variable displacement pump 10 according to the invention. That is, by adopting a vehicle speed sensor and a steering speed sensor together as an electronic control, it is possible to obtain a comfortable steering feeling and an energy saving effect.

Here, in the control apparatus in the above-mentioned variable displacement pump 10, conversion tables—of speed of vehicle vs. current, and steering speed vs. current, to control current passing through the solenoid 60 corresponding to signals from the speed sensor 63 and the steering sensor 64—are provided in the CPU 61, which is the electronic control unit, and current control is carried out corresponding thereto. The detailed description is omitted.

In short, the spool 32 of the control valve 30 is kept in a balanced state with a difference in fluid pressure so as to be flow-rate controlled by the metering throttle 50, and the minimum flow rate of the pump 10 is discharged in this state at non-steering. At this time, it can be set so as to keep a suitable minimum flow rate even at steering such as maintaining steering at turning travel, and correcting steering. Further, it is possible that response delay does not occur when flow rate is increased from the minimum flow rate such as at quick steering.

By putting the solenoid 60 in a non-conductive state at non-steering, by putting the solenoid 60 in a conductive state (to generate solenoid thrust) when steering is required, and by moving the spool 32 together with spring force, power consumption is usefully made minimum.

Further, by controlling the control valve 30, power consumption to drive the pump as a variable capacitor pump 10 is made minimum, and it is possible to improve the energy saving effect.

In the above-mentioned control valve 30, if section area of the spool 32 is 1.33 $cm^2$, for example, differential pressure at the metering throttle 50 is 0.07 MPa when solenoid thrust is OFF at non-steering and the minimum flow rate of 4 l/min is obtained. Because force by the differential pressure and spring force 9.29 N are balanced, the spool 32 obtains a balanced state.

On the other hand, when current flows through the solenoid 60 and solenoid thrust of 17.26 N acts during quick steering, the spool 32 moves to the left direction in the figure. Then, force by differential pressure at the metering throttle 50, solenoid thrust, and spring force act together. At this time, differential pressure is 0.2 MPa and maximum flow rate 7 l/min is obtained.

In the above-mentioned structure, solenoid thrust is removed when electronic control is defective due to a defect in any of the elements constructing the electronic control unit. However, even at this time, the spool 32 is kept at the balanced state by differential pressure between upper and lower sides of the metering throttle 50. Therefore, pump discharge quantity of the minimum flow rate previously set, and necessary minimum steering performance, can be kept.

The invention is not limited to the structure described in the embodiment and it is needless to say that shape and construction of each part can be suitably deformed and changed.

Although minimum flow rate supplied from the pump is 4 l/min for example in the embodiment, smaller flow rate than the above may be set without limitation, if steering power is enough for the travel condition such as speed of the vehicle and steering speed.

In the embodiment, driving current to solenoid 60 is controlled by the CPU 61 and the driving circuit 62 which are used as the electronic control portion to control the electronic driving unit such as the solenoid and the like. Speed of vehicle from the speed sensor 63 and steering speed from the steering sensor 64 are input to the CPU 61 as input signals. However, the invention is not limited to this, and discharge flow rate of the pump may be controlled by adding various travel conditions of the vehicle, such as revolution cycle of the engine, steering angle, steering direction, and axle load.

Figure 7:
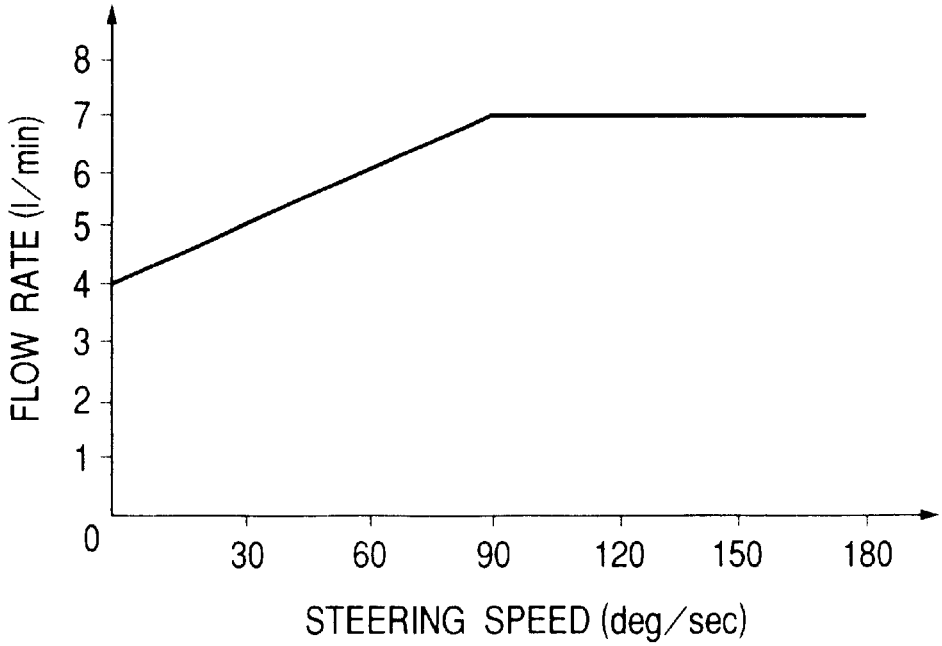
FIG. 7 shows a supply flow rate characteristic vs. steering speed when the variable displacement pump according to the invention is used as a fluid pressure source of a power steering system.

For example, as shown in FIG. 7, driving current to the solenoid 60, which is the electronic driving unit, is controlled using steering speed from the steering sensor 64 as an input signal. Further, it may be constructed that the solenoid is in a non-conductive state at non-steering and the solenoid is in a conductive state at steering. Of course, the invention is not limited to control by using only steering speed as the input signal.

Although the electronic driving unit is the solenoid 60 for example, the electronic driving unit is not limited to this and may be a unit comprising a driving apparatus such as an electro-magnetic device and an electric motor coupled directly or indirectly through a mechanical transfer unit such as a lever, cam and etc. An example is shown in Japanese Patent Publication No. 4135/1979.

In the embodiment, the variable displacement pump 10 is used for an oil pressure source of a power steering system installed in a vehicle. However, the invention is not limited to this, and it is applicable wherein reliability of operation of an apparatus using pressure fluid is maintained by increasing or decreasing supplying flow rate in response to a necessary condition, and wherein pump power is reduced so as to show an energy saving effect.

Although the metering throttle 50 comprising the fixed throttle is provided on the position facing the side wall of the cam ring 17 in the embodiment, the invention is not limited to this. The metering throttle may be provided at any suitable position of the discharge side passage 27. In short, fluid pressure of the upper and lower stream sides of the metering throttle 50 may be conducted to both side chambers 38 and 36 of the control valve 30.

Although the rod member 71 is connected to the end portion of the spring chamber 36 side of the spool 32 in order to apply axial thrust of the solenoid 60 to the spool 32 of the control valve 30, this has the purpose of sharing the spool 32 with a pump of another type, and these may be connected integratedly by press fitting or may be formed integratedly. Further, a variation is possible wherein the rod member 71 and the rod 65 of the solenoid 60 are formed in one body or integratedly, and the end portion of the spool 32 and the rod member 71 are faced in an almost contacting state.

As described above, according to the variable displacement pump of the invention, an electronic driving unit applying axial thrust to the spool of the control valve is provided, therefore the invention has the following superior advantages in spite of its simple structure.

That is, since pump discharge quantity can be made minimum at non-steering, such as straight travel, power consumption can be saved. When pump discharge quantity, such as while steering, is necessary, force by the electronic driving unit acts directly on the spool of the control valve so that necessary flow rate can be discharged quickly.

According to the invention, since the metering throttle is a fixed throttle having a certain opening area, a small differential pressure keeps the spool in a balanced state with the minimum flow rate at non-steering. Therefore, since pressure loss of fluid at the metering throttle in this state is small, power consumption of the pump can be further decreased.

According to the invention, since the sum of thrust by the electronic driving unit and spring force of the control valve is the same as spring force of the conventional control valve, a spring having a smaller spring force can be used for the control valve as compared with the conventional spring, and the control valve can be operated smoothly in a manner similar to that of the conventional pump. Therefore, power consumption at pump driving is made minimum and the maximum energy saving effect is obtained with low cost.

According to the invention, when an oil pressure pump for a vehicle is used for an oil source of a steering system, for example, since the pump discharge quantity is controlled through the control valve by driving the electronic driving unit corresponding to a condition such as the speed of the vehicle, the steering speed, and etc., suitable steering feeling is obtained fitting various travel states of the vehicle.

What is claimed is:

1. A variable displacement pump comprising:

a rotor;

a cam ring defining a pump chamber between the rotor and the cam ring;

a pump body holding the cam ring for movement in a direction whereby a pump capacity of the pump chamber increases and decreases, the pump body defining a first fluid pressure chamber and a second fluid pressure chamber, wherein the first and second fluid pressure chambers are at opposite sides, in the moving direction, of the cam ring;

a control valve having a spool movable in an axial direction by a difference in fluid pressure between an upper stream side and a lower stream side of a metering throttle that is connected to a discharge side passage of the pump chamber, the control valve for controlling at least fluid pressure in the first fluid pressure chamber; and an electronic driving unit for directly applying axial thrust to the spool.

2. The variable displacement pump according to claim 1, further comprising an electronic control unit for driving and controlling the electronic driving unit, wherein the electronic control unit includes a steering sensor for detecting a steering speed of a steering wheel, and the electronic control unit drives and controls the electronic driving unit according to a signal from the steering sensor.

3. The variable displacement pump according to claim 2, wherein the electronic control unit includes a speed sensor for detecting a travel speed of a vehicle, and the electronic control unit drives and controls the electronic driving unit according to a signal from the speed sensor.

4. The variable displacement pump according to claim 3, wherein the electronic control unit controls flow rate of fluid in accordance with the signal from the speed sensor.

5. The variable displacement pump according to claim 4, wherein the electronic control unit includes a steering sensor fir detecting steering speed of a steering wheel, and further wherein the electronic control unit controls the flow rate of the fluid in accordance with a signal from the steering sensor.

6. The variable displacement pump according to claim 5, wherein the electronic control unit controls the flow rate of the fluid so that the flow rate is minimum when the steering wheel is not operated.

7. The variable displacement pump according to claim 2, wherein the electronic control unit controls flow rate of fluid in accordance with the signal from the steering sensor.

8. The variable displacement pump according to claim 7, wherein the electronic control unit controls the flow rate of the fluid so that the flow rate is minimum when the steering wheel is not operated.

9. The variable displacement pump according to claim 1, further comprising a spring that biases said spool in one direction, wherein said one direction is the same as that in which said electronic driving unit applies axial thrust to the spool.

10. The variable displacement pump according to claim 9, wherein the electronic control unit includes a steering sensor for detecting steering speed of a steering wheel, and further wherein the electronic control unit controls flow rate of fluid in accordance with a signal from the steering sensor.

11. The variable displacement pump according to claim 10, wherein the electronic control unit controls the flow rate of the fluid so that the flow rate is minimum when the steering wheel is not operated.

* * * * *